US008422717B2

(12) United States Patent
Lin et al.

(10) Patent No.: US 8,422,717 B2
(45) Date of Patent: Apr. 16, 2013

(54) ADJUSTABLE AUDIO HEADPHONE

(75) Inventors: You-ruei Lin, Tu Cheng (TW); Chun-hung Chen, Tu Cheng (TW); Meng-ching Cho, Tu Cheng (TW); Mu-tsun Tseng, Tu Cheng (TW)

(73) Assignee: Cheng Uei Precision Industry Co., Ltd., Tu Cheng, Taipei (TW)

( * ) Notice: Subject to any disclaimer, the term of this patent is extended or adjusted under 35 U.S.C. 154(b) by 269 days.

(21) Appl. No.: 12/907,987

(22) Filed: Oct. 19, 2010

(65) Prior Publication Data

US 2012/0093332 A1 Apr. 19, 2012

(51) Int. Cl.
*H04R 25/00* (2006.01)

(52) U.S. Cl.
USPC ..... 381/372; 381/373; 381/370; 381/71.6; 181/129

(58) Field of Classification Search ..... 381/370–383, 381/71.6, 72; 181/129–130, 135
See application file for complete search history.

(56) References Cited

U.S. PATENT DOCUMENTS 3,999,020 A * 12/1976 Bastiaans et al. ..... 381/372
4,742,887 A * 5/1988 Yamagishi ..... 181/129
2012/0057738 A1* 3/2012 Lin ..... 381/370

* cited by examiner

*Primary Examiner* — Davetta W Goins
*Assistant Examiner* — James Mooney
(74) *Attorney, Agent, or Firm* — Cheng-Ju Chiang

(57) ABSTRACT

Provided is an adjustable audio headphone, including a headphone body, a damping object and a pressing mechanism. The headphone body includes a headphone shell, which forms a sound cavity in inside thereof and a receiving chamber on one end thereof. A bottom surface of the receiving chamber forms a through hole communicated with the sound cavity. The damping object is made of compressible material such as sponge, elastic plastic, textile and so on and. The damping object is placed into the receiving chamber of the headphone shell. The pressing mechanism is mounted on the headphone shell and is capable of pressing the damping object. The adjustable audio headphone of the present invention can compress the damping object to change the density of the damping object by employing the pressing mechanism, thereby varying the pressure of the sound cavity and realizing the object of adjusting the audio thereof.

2 Claims, 3 Drawing Sheets

ADJUSTABLE AUDIO HEADPHONE

BACKGROUND OF THE INVENTION

1. Field of the Invention

The present invention relates to a headphone, and more particularly to an adjustable audio headphone.

2. Description of the Prior Art

With the development of science and technology, electronic products are continuous upgraded. In order to assure that users can listen to the sound generated by the electronic product under the state of not interfering with others, a headphone is served as a necessary accessory of the electronic product.

Everybody has his own taste for music. But because the traditional headphone has a fixed structure, the sound effect produced by the headphone cannot be adjusted. Therefore, the traditional headphone cannot satisfy the individual needs.

For adjusting the sound in bass range, the pressure inner a rear chamber of the traditional headphone can be varied by placing or not placing a damping object into the rear chamber for changing the damping effect of the traditional headphone. So the sound and the sound pressure in the bass range can be controlled and matched with the sound in the treble range. The damping object also can prevent foreign matters, which may cause noise or destroy the headphone, from entering into the headphone body. But an ordinary consumer cannot freely replace the damping object in the traditional headphone, but receive the sound, which is generated by the headphone and cannot be adjusted. Therefore, the traditional headphone is not convenient in use.

BRIEF SUMMARY OF THE INVENTION

An object of the present invention is to provide an adjustable audio headphone, which can vary the pressure in a sound cavity for adjusting the sound effect.

To achieve the above object, in accordance with the present invention, an adjustable audio headphone is provided, comprising a headphone body, a damping object and a pressing mechanism. The headphone body includes a headphone shell, which forms a sound cavity in inside thereof and a receiving chamber on one end thereof. A bottom surface of the receiving chamber forms a through hole communicated with the sound cavity. The damping object is made of compressible material such as sponge and is placed into the receiving chamber of the headphone shell. The pressing mechanism is mounted on the headphone shell and is capable of pressing the damping object.

Based on the above description, the adjustable audio headphone of the present invention employs the pressing mechanism to press the damping object to change the density of the damping object, so that varying the pressure of the sound cavity and realizing the object of adjusting the audio thereof.

DETAILED DESCRIPTION OF THE PREFERRED EMBODIMENTS

The following embodiment with reference to the accompanying drawings now has been given for detail describing the technology, the feature, the object and the effect of the present invention.

Figure 1:
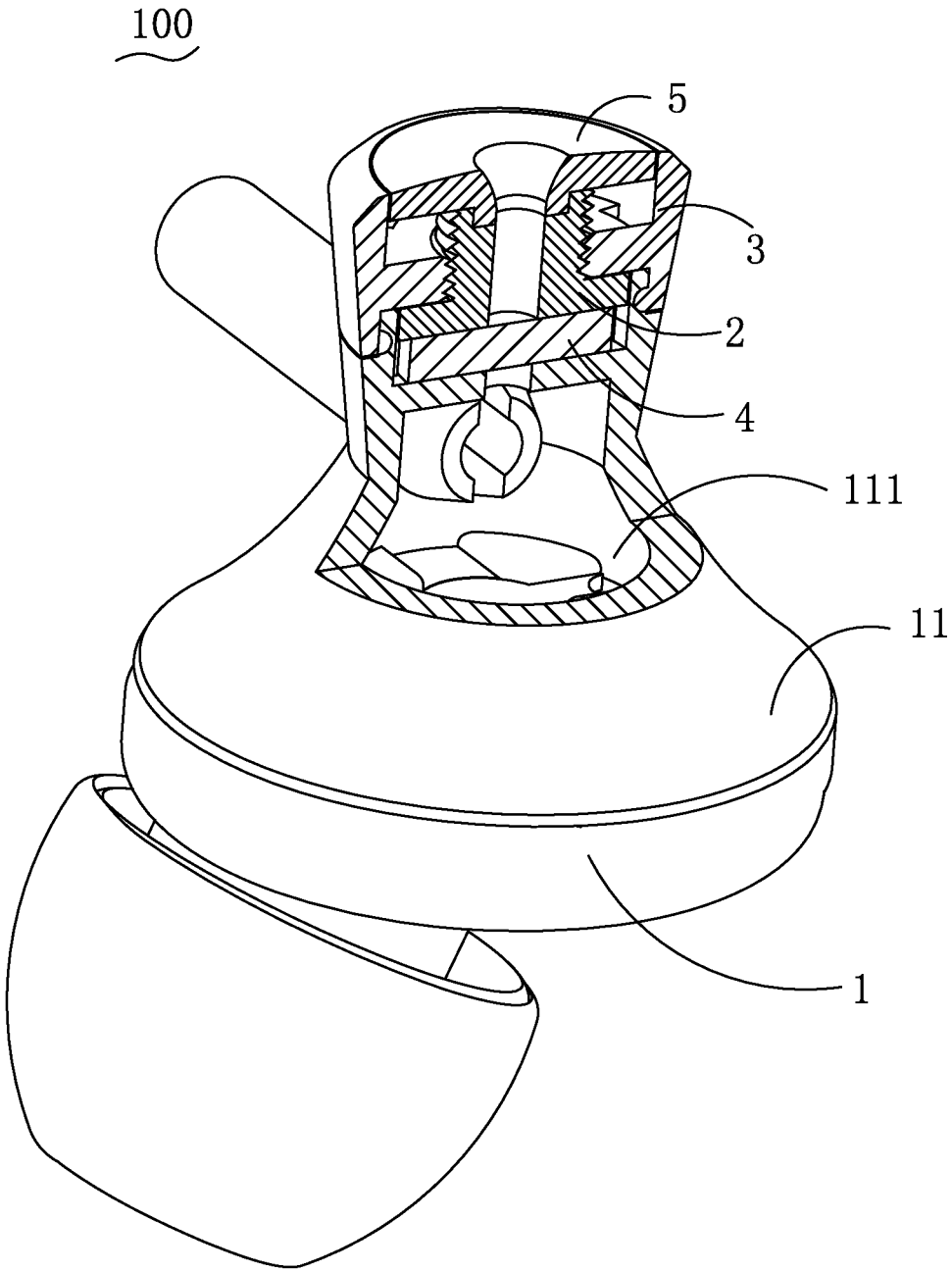
FIG. 1 is a perspective view of an adjustable audio headphone according to one embodiment of the present invention, part of which is showing in section.

Please refer to FIG. 1, an adjustable audio headphone 100 of the present invention comprises a headphone body 1, a damping object 4, a cover 5 and a pressing mechanism.

Figure 2:
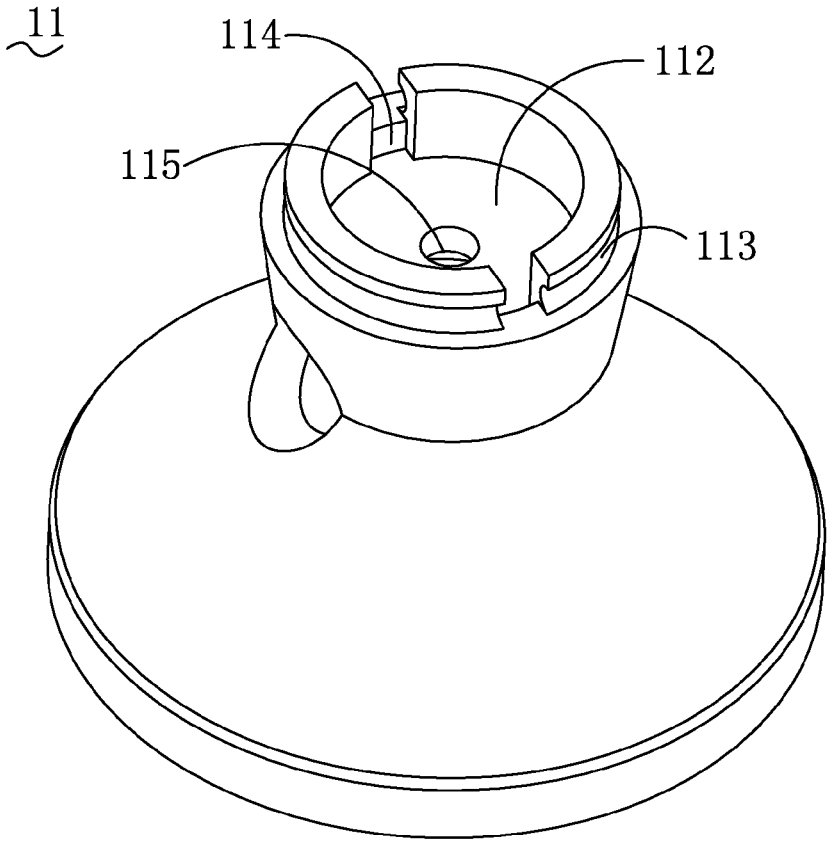
FIG. 2 is a perspective view of a headphone shell of the adjustable audio headphone of FIG. 1.
Figure 3:
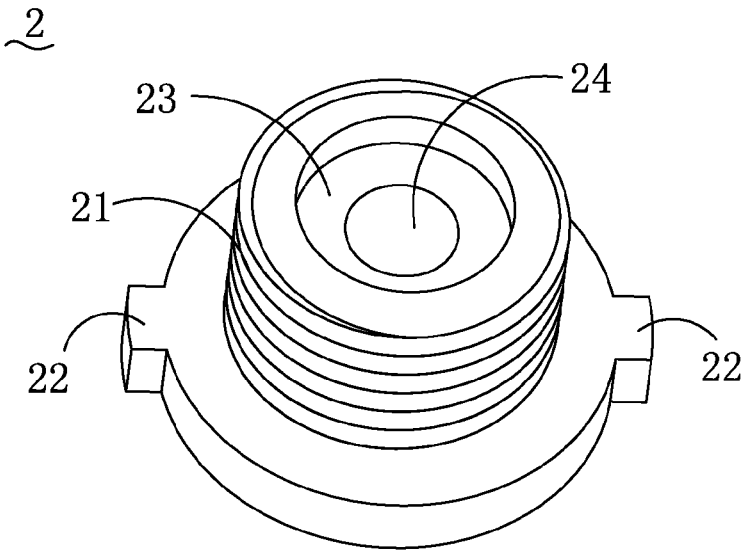
FIG. 3 a perspective view of a pressing member of the adjustable audio headphone of FIG. 1.
Figure 4:
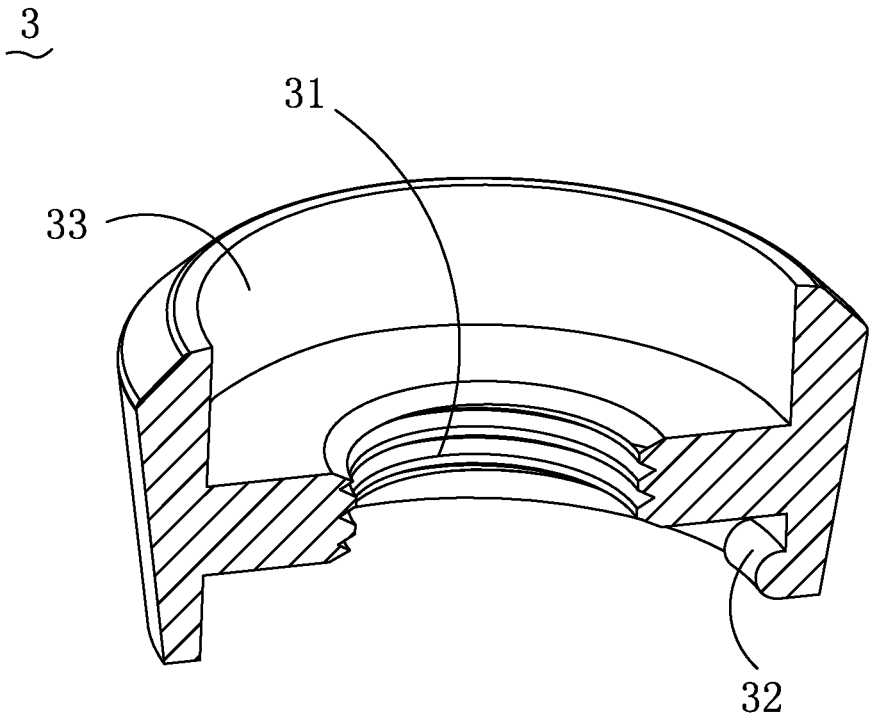
FIG. 4 a partial sectional view of a rotating member of the adjustable audio headphone of FIG. 1.
Figure 5:
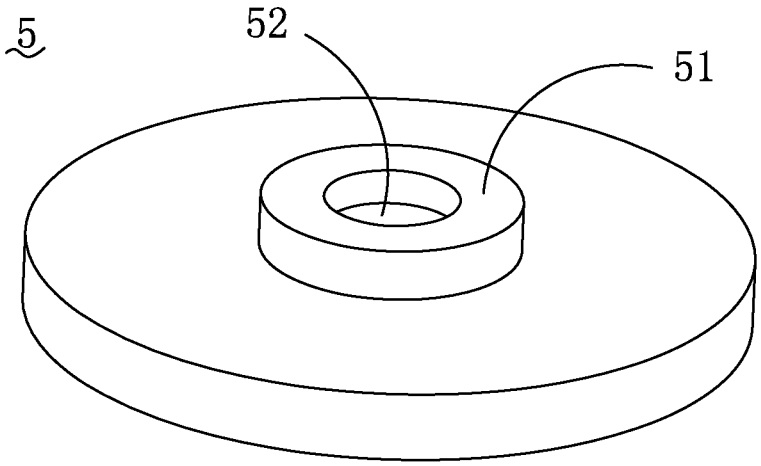
FIG. 5 a perspective view of a cover of the adjustable audio headphone of FIG. 1.

Please refer to FIGS. 1 and 2, the headphone body 1 includes a headphone shell 11 forming a sound cavity 111 in inside thereof. The headphone shell 11 forms a receiving chamber 112 on one end thereof. A bottom surface of the receiving chamber 112 forms a through hole 115 communicated with the sound cavity 111. A sidewall of the receiving chamber 112 forms two limiting grooves 114. An outside surface of the sidewall of the receiving chamber 112 forms an annular groove 113.

Referring to FIG. 1, the damping object 4 is made of elastic and compressible material such as sponge, elastic plastic, textile and so on, the density of which can be changed by compressing. The damping object 4 is placed into the receiving chamber 112 of the headphone shell 11.

Referring to FIGS. 1 to 4, the pressing mechanism is mounted on the headphone shell 11 to press the damping object 4. On one embodiment, the pressing mechanism includes a pressing member 2 and a rotating member 3. The pressing member 2 is received in the receiving chamber 112 and presses onto the damping object 4. The pressing member 2 disposes a screw section 21 on an outside surface thereof. The pressing member 2 disposes an interconnecting hole 24 communicated with the through hole 115 and the sound cavity 111. One end of the pressing member 2 disposes two holding blocks 22, each of which is separately received in one limiting groove 114, and the other end thereof forms a concave portion 23. The rotating member 3 disposes a screw section 31, engaged with the screw section 21 of the pressing member 2, on an inside surface thereof. The rotating member 3 forms a receiving cavity 33 on one end thereof. The rotating member 3 also disposes a plurality of latch portions 32, which can enter into the annular groove 113 for catching the headphone shell 11.

Referring to FIGS. 1, 3, 4 and 5, the cover 5 is placed in the receiving cavity 33, and disposes a protruding ring 51 engaged with the concave portion 23. The cover 5 forms an opening 52 communicated with the interconnecting hole 24. The cover 5 is used to prevent foreign matter from entering the space between the screw sections 21, 31 of the pressing member 2 and the rotating member 3.

The sound cavity 111 is communicated with outside. When needing to adjust the audio of the headphone 100, the rotating member 3 can be driven to rotate to adjust the height of the pressing member 2 and the tightness between the pressing member 2 and the damping object 4, and to further change the density of the damping object 4, thereby varying the pressure in the sound cavity 111 to realize the object of adjusting the audio of the headphone 100.

As described above, the adjustable audio headphone 100 of the present invention employs the pressing mechanism to press the damping object 4 to change the density of the damping object 4, so that varying the pressure of the sound cavity 111 and realizing the object of adjusting the audio thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustable audio headphone comprising:

a headphone body, including a headphone shell, which forms a sound cavity in an inside thereof and a receiving chamber on one end thereof, wherein a bottom surface of the receiving chamber forms a through hole communicated with the sound cavity;

a damping object, being placed into the receiving chamber of the headphone shell; and a pressing mechanism, being mounted on the headphone shell and being capable of pressing the damping object;

wherein the pressing mechanism includes a pressing member and a rotating member; the pressing member being received in the receiving chamber to press onto the damping object, and the pressing member disposing a screw section on an outside surface thereof, an interconnecting hole communicated with the through hole and the sound cavity, two holding blocks protruding on one end thereof, and a concave portion on the other end thereof; the rotating member disposing a screw section engaged with the screw section of the pressing member on an inside surface thereof, a receiving cavity on one end thereof, and a plurality of latch portions; the headphone shell disposing two limiting grooves on a sidewall of the receiving chamber and an annular groove on an outside surface of the sidewall of the receiving chamber; the two holding blocks being separately received in the corresponding limiting grooves, and the latch portions is held in the annular groove.

2. The adjustable audio headphone as claimed in claim 1, further comprising a cover placed in the receiving cavity of the rotating member, wherein the cover disposes a protruding ring engaged with the concave portion of the pressing member, and an opening communicated with the interconnecting hole.

* * * * *